United States Patent [19]

Alifano

[11] 4,106,387

[45] Aug. 15, 1978

[54] STRINGED MUSICAL INSTRUMENT

[76] Inventor: Arthur William Alifano, P.O. Box 467, West Sand Lake, N.Y. 12196

[21] Appl. No.: 668,553

[22] Filed: Mar. 19, 1976

[51] Int. Cl.[2] ..... G10D 3/14

[52] U.S. Cl. ..... 84/312 P

[58] Field of Search ..... 84/312

[56] References Cited

U.S. PATENT DOCUMENTS

| | | | |
|---|---|---|---|
| 2,458,263 | 1/1949 | Harlin | 84/312 |
| 2,914,982 | 12/1959 | La Bossier | 84/312 |
| 3,136,198 | 6/1964 | Smith et al. | 84/312 P |
| 3,422,716 | 1/1969 | Alifano | 84/312 |
| 3,447,413 | 6/1969 | Lashley et al. | 84/312 P |

*Primary Examiner*—Lawrence R. Franklin
*Attorney, Agent, or Firm*—Pollock, Vande Sande & Priddy

[57] ABSTRACT

A stringed musical instrument including a panel provided with a plurality of playing strings extended longitudinally thereon. Tuning keys are provided at one end of the panel and one end each of the playing strings is secured thereto, while the other ends of the playing strings are operatively associated to a pitch changing device. The pitch changing device is located at the other end of the panel and comprises a plurality of individual units, one for each string carried by the musical instrument. The individual units are capable of producing a bi-directional string tension adjustment in every string associated therewith in either direction, simultaneously, or separately, to provide an increase in the tension of the string, and therefore, raise the pitch thereof, or to provide a decrease in the tension of the string, and therefore, lower the pitch thereof. The bi-directional string tension adjustment can be accomplished by the mutual cooperation of a pair of levers pivotally mounted side by side on a shaft supported across the panel.

7 Claims, 8 Drawing Figures

STRINGED MUSICAL INSTRUMENT

FIELD OF THE INVENTION

The present invention relates to improvements in stringed musical instruments, and more specifically, to a novel mechanism for changing the pitch of individual strings in pedal steel guitars, e.g., as disclosed in applicant's prior U.S.Pat. No. 3,422,716.

BACKGROUND OF THE INVENTION

This invention relates to stringed musical instruments of the type which are played by plucking the strings in a well known manner, and more particularly but not exclusively the invention relates to so-called pedal steel guitars having one or more necks and provided with pedals or the like by means of which the player may raise or lower the pitch of one or more strings to obtain tones above or below those to which the strings are normally basically tuned.

The prior art discloses such stringed instruments having pedal-operated means for raising or lowering the pitch of individual strings, and although such mechanisms have performed well, they are generally characterized by certain deficiencies, and have failed to provide the player with a pitch changing device which:

(a) is not complex in its construction;

(b) is easily and readily adjusted;

(c) can be changed over from the original tuning setup without any disassembly being required;

(d) can offer a pitch changing capability with unlimited potential, for example, to be able to raise and lower the pitch of any string with a given pedal, and to be able to raise and lower in any combination, e.g. raise the pitch of two strings and lower the pitch of three strings with any given pedal;

(e) can activate all of the strings as many times as there are pedals and/or knee levers to as many possible different pitches;

(f) can perform the function of proportional differences of notes.

The present invention contemplates an improved construction provided with novel means for raising or lowering the pitch of individual strings in infinitely variable steps between the extremes of the range provided. Thus, by not limiting the degree of variations in the pitch which the player may obtain from each of the strings on the musical instrument, he may obtain any tonal or chordal effects he so desires.

OBJECTS OF THE INVENTION

It is a principal object of the invention to provide an improved mechanism to change the pitch of individual strings in pedal steel guitars, made up of a few simple parts, rugged in design, positive and accurate in its operational function, and which can be manufactured at low cost.

Another object of the invention is the provision of novel pedal-operated means whereby all of the strings on each neck of the instrument may be selectively tensed or loosened by the player to produce any tone within the available range, such changing of pitch being quickly and easily accomplished while the instrument is being played.

Another object of the instant invention resides in the fact that the player of the instrument is able to raise and lower the tension of certain individual strings at the same time while leaving others unchanged.

Still another object of this invention is that the player can conveniently and quickly make changes in the original tuning setup by merely resetting the adjustment screws without any special tools or apparatus, or without any disassembly being required.

Yet another object is the provision of a multiplicity of accurately adjustable sets of stops, wherein each such set of stops serves to provide a different set of tone variations in the selected strings, thereby multiplying the number of different tones which each string may emit. Strings can be activated as many times as the number of pedals or knee levers on a neck, giving as many possible different pitches. For example, Pedal No. 1 can raise a G-string one-half tone, Pedal No. 2 can raise the same string one full tone; and Pedal No. 3 can lower the same string one-half tone, Pedal No. 4 can lower the same string one full tone, Knee Lever No. 1 can lower the same string a tone and a half.

A further object of the invention is to provide a bi-directional string tension adjusting mechanism, which is designed in such a manner that it will provide accurately adjustable proportional differences of notes. For example, a player might set Pedal No. 1 to lower the pitch of a string a half tone, then set Pedal No. 2 (the adjacent pedal) to raise the pitch of the same string one full tone. When both pedals are depressed simultaneously, he may obtain a half tone raise, i.e. a third function, which is a combination of the first and second pedal actions or a proportional difference of notes.

Another object of the invention is the provision of a stringed musical instrument which has the ability to raise, to lower, and to raise and lower the tension of every individual string at the same time, individually, or in any combination by actuating any single pedal provided in the instrument. The number of changes that a player can obtain with the mechanism of the present invention depends on the number of pedals and the number of knee levers, times the number of strings provided on the steel guitar. Therefore, the tuning versatility obtained with this novel mechanism is such that the player has a multiplicity of tone changes in each individual string, whereby he can fully express himself to form structurally complete and emotionally expressive compositions.

These objects and others, according to the invention, are attained by providing a plurality of individual units, one for each string of the instrument arranged so that a bi-directional string tension adjustment is possible in each individual string in response to a single pedal associated therewith.

The unit comprises a pair of levers mounted side by side and relatively movable to each other. One of the elements has a controlling pin and a round hole which serves as a fixed pivot point, while the other element has an eccentric cam slot and an elongated hole which serves as a floating pivot point, both members being mechanically associated through the pin received within the cam slot.

The levers which constitute the units are pivotally mounted in a juxtaposed fashion and packed together on a fixed shaft which extends across one end of the instrument. Each of the levers which constitute the units, extends downwardly through an opening which is formed by rectangular frames, each such frame being appropriately mounted in vertical plate-like supporting arms, and provided with co-planar grooves to facilitate their positive longitudinally slidable movement.

Adjusting set screws extend through the rearward members of the frame, one for each of the downwardly extending levers, such screws being selectively and individually adapted to be screwed toward or away from the levers, thereby affording a means of adjusting the amount of pivotal movement of the levers. The sliding movements of each said frame are controlled by means of bell crank arms, connecting rods, and like linkages associated therewith, upon response to the pedal or knee lever connected thereto.

BRIEF DESCRIPTION OF THE DRAWINGS

The above and other objects, features and advantages of the present invention will become more readily apparent from the following description, reference being made to the accompanying drawings in which.

DETAILED DESCRIPTION OF THE PREFERRED EMBODIMENT

Figure 1:
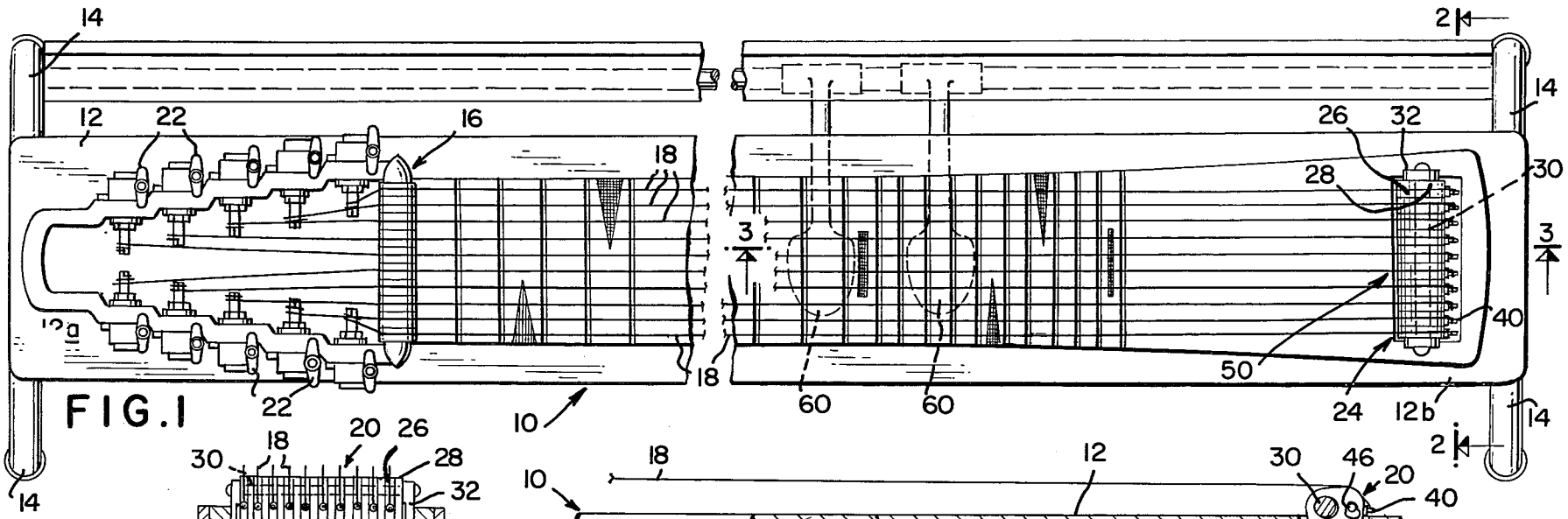
FIG. 1 is a top plan view of a pedal steel guitar embodying features of the present invention.

FIG. 1 shows a single neck pedal steel guitar 10 which comprises a pedal 12 conveniently supported on legs 14. A "nut" 16 is mounted adjacent one end 12*a* of panel 12 which constitutes a fixed support for a plurality of strings 18 extending longitudinally along the panel 12.

As can be seen in FIG. 1, only 10 strings 18 are shown. Furthermore, the invention is described primarily with reference to a single string of the instrument and to a bi-directional string tension changing mechanism associated therewith.

A pitch changing device 20 is operatively associated with one end of the strings 18 while tuning keys 22 are connected in a conventional manner to the other end of the strings. The tuning adjustment accomplished by means of the tuning keys 22 is merely a relatively fixed tuning to establish the proper initial condition of each of the strings 18.

The pitch changing device 20 comprises a plurality of bi-directional string tension changing units 24 consisting of a pair of levers 26 and 28 pivotally mounted side by side on a fixed shaft 30 supported across panel 12 by means of brackets 32 arranged at one end 12*b* of panel 12.

The number of bi-directional string tension changing units 24 depends upon the number of strings 18 carried by the musical instrument 10. Thus, for instance, if the pedal steel guitar carries ten strings, the pitch changing device 20 will carry ten bi-directional string tension changing units 24, one for each string.

The levers 26 and 28 will be named as pitch raising lever and pitch lowering lever, respectively, to facilitate the understanding of the function performed by each lever with reference to each string associated therewith.

Figure 4:
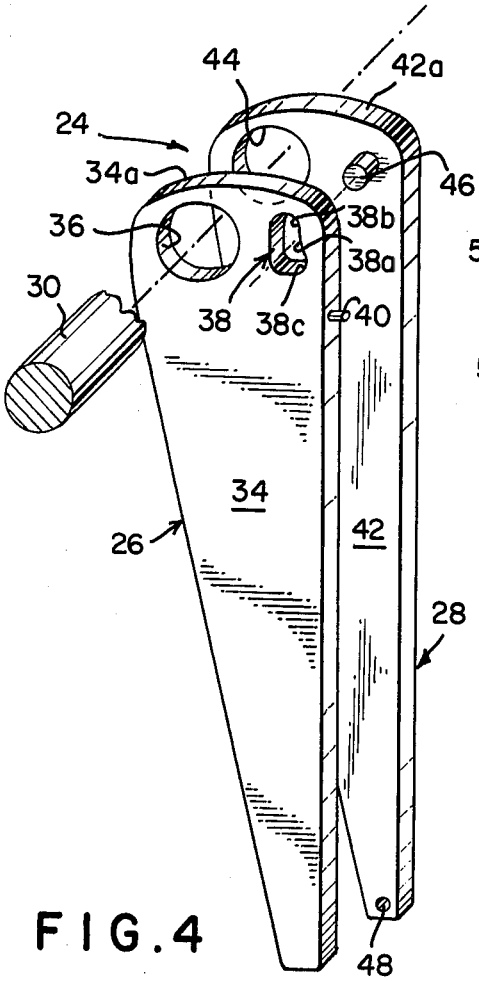
FIG. 4 shows an exploded partial perspective view of an individual unit which constitutes the bi-directional string tension changing mechanism.

Referring now to FIG. 4, the pitch lowering lever 28 comprises an elongated flat member 42 which may have substantially the same configuration as member 34, but slightly longer. The member 42 includes a circular hole 44 and a controlling pin 46 located near the upper end 42*a* of the member 42. Since both members 34 and 42 are pivotally mounted side by side on shaft 30, the controlling pin 46 of the member 42 will be located within eccentric cam slot 38 to cooperate with the cam surfaces 38*a*, 38*b*, and 38*c* during the bi-directional changing of the tension of the string when the player is activating the mechanism.

Figure 5:
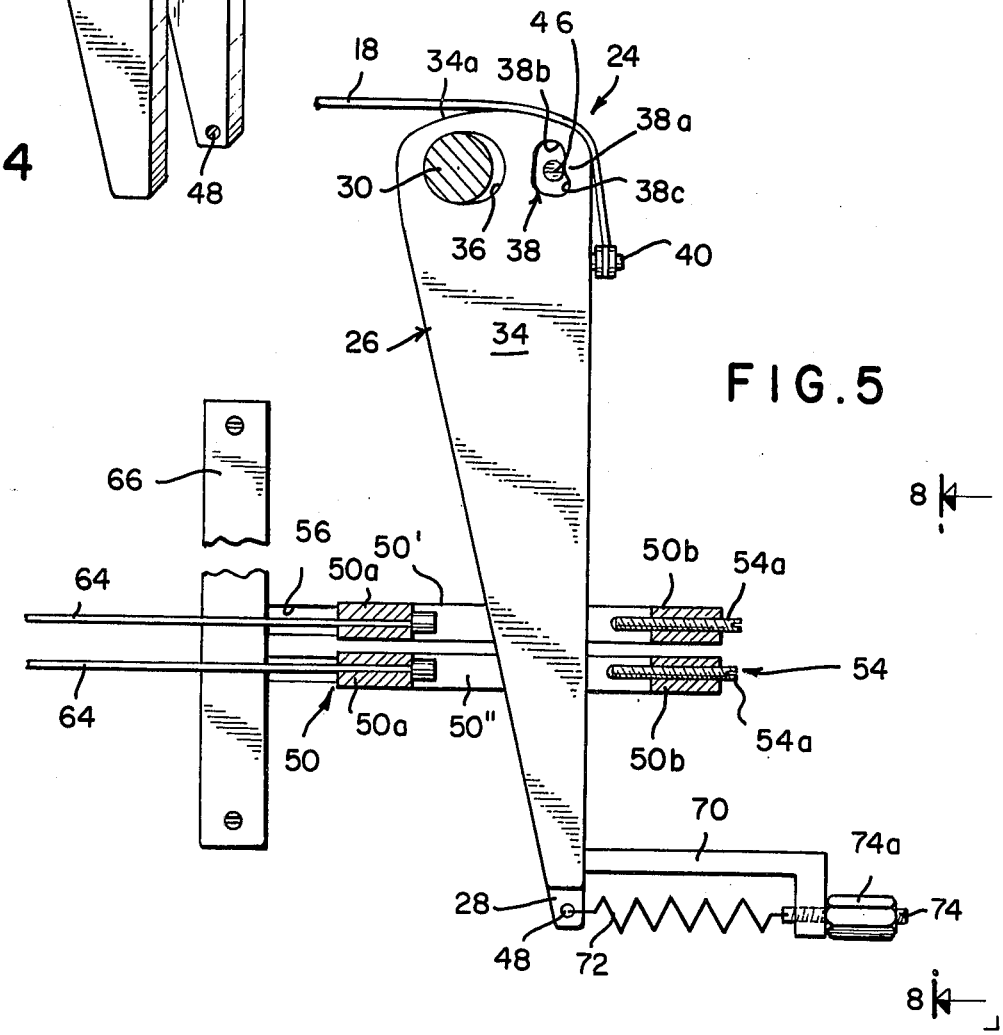
FIG. 5 is a schematic view showing the relationship between the pitch raising and lowering levers with an individual string of the instrument in an inactive position.

Referring now to FIG. 5, the pitch raising lever 26 comprises an elongated flat member 34 including an oblong hole 36 and an eccentric cam slot 38 adjacent to the upper end 34*a*. A string anchor pin 40 is provided at the upper rear edge of the pitch raising lever 26 wherein one end of the string 18 is secured thereto. The eccentric cam slot 38 includes a plurality of cam surfaces 38*a*, 38*b*, and 38*c*. The specific purpose of these cam surfaces will be explained hereinafter.

Figure 8:
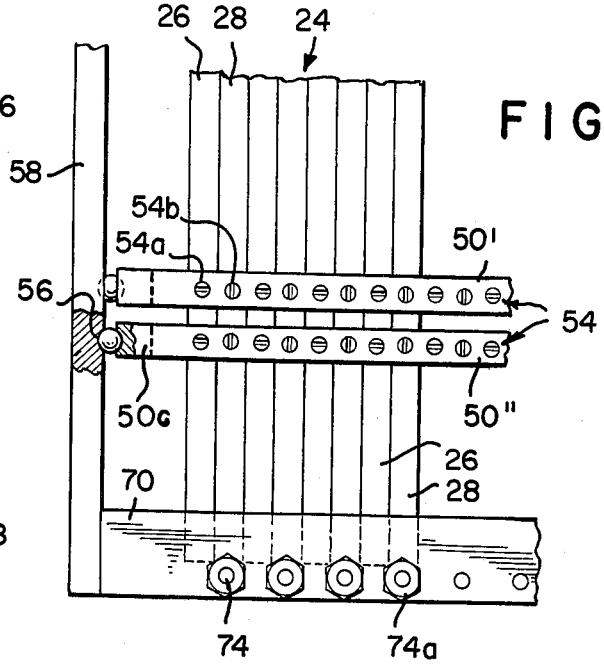
FIG. 8 is a partial schematic rear end view of the bi-directional string tension mechanism taken along lines 8—8 of FIG. 5.

As can be seen in FIG. 5, each rectangular frame 50 has forward and rear frame members 50*a* and 50*b*, respectively, and lateral end members 50*c*, as seen in FIG. 8. The pitch raising levers 26 and the pitch lowering levers 28 which are pivotally mounted on shaft 30 (FIG. 5) extend downwardly through the frames 50 between forward and rear frame members thereof.

Figure 3:
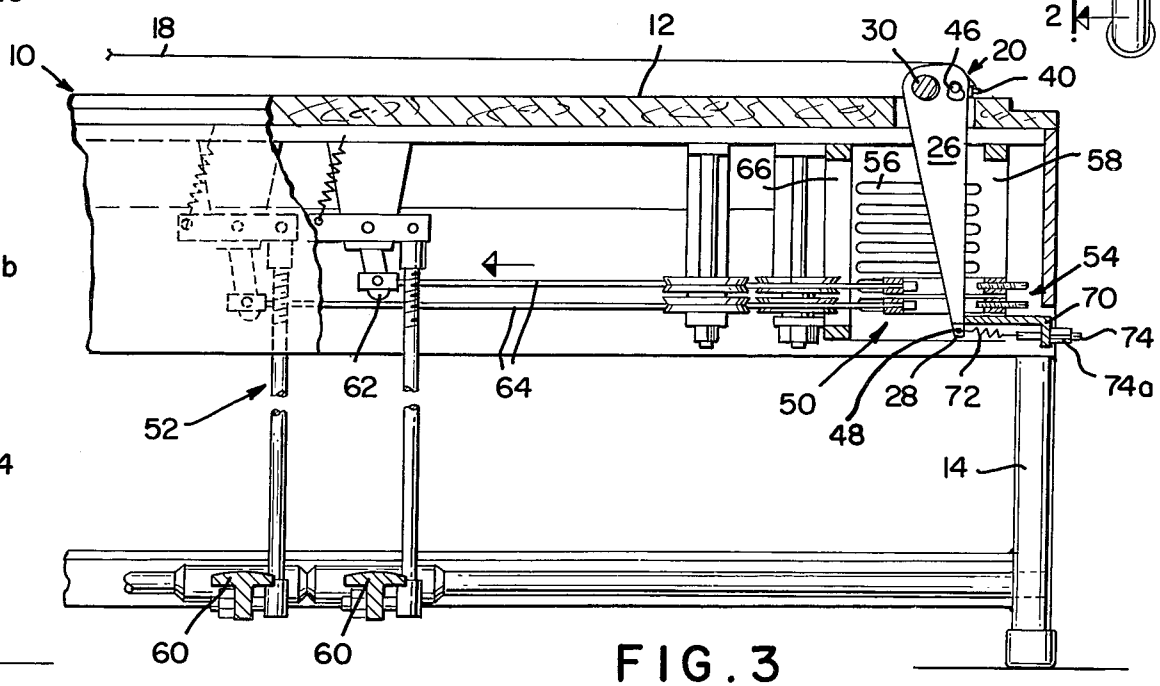
FIG. 3 illustrates a rear elevational view taken along lines 3—3 of FIG. 1 with parts broken away and partly in section.

The forward frame member 50*a* is operatively connected to a pedal operated mechanism 52 (as shown in FIG. 3) while the rear frame member 50*b* carries a plurality of adjustable screws 54 which extend through the thickness thereof.

Referring to FIG. 8, set screws 54 are provided directly behind each pitch raising and lowering lever 26 and 28. Such set screws 54 are selectively and individually adapted to be screwed toward or away from the levers 26 and 28 in order to regulate the degree of rotatable movement thereof about shaft 30. More specifically, each frame 50 is provided with an adjustment screw 54*a* to raise the pitch of an individual string, and an adjustment screw 54*b* to lower the pitch thereof. The rectangular frames 50 which are bias loaded through means not shown are arranged one above the other at corresponding parallel grooves 56 provided in both lateral end members 50*c* of frame 50, and the supporting walls 58 which extend downward from the panel 12. Both lateral ends of the frame may be provided with frictionless means such as ball bearings, rollers or the like to obtain smooth sliding movement within the grooves 56.

Figure 2:
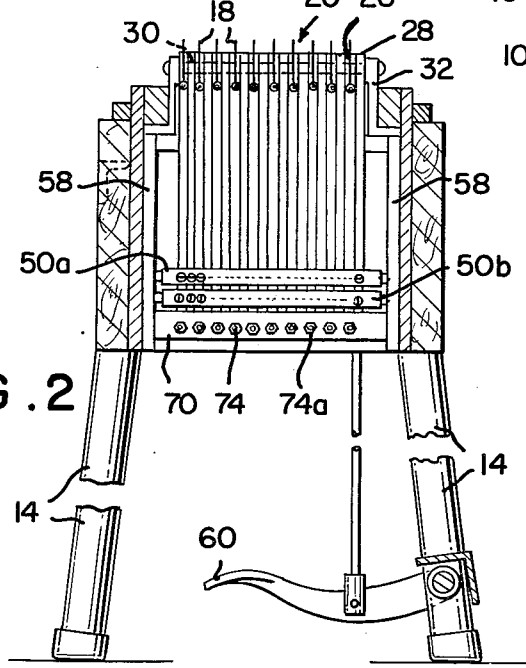
FIG. 2 shows an end elevational view taken along lines 2—2 of FIG. 1 with some parts broken away and partly in section.

Only two frames 50 are shown in FIGS. 2 and 3. The number of frames 50 will depend upon the number of pedals and knee levers carried by the musical instrument. Each frame 50 is actuated by an individual pedal 60 which is generally mounted at the bottom of the musical instrument. Some pedal steel guitars may be provided with ten pedals at the bottom and four additional pedals, one at each side of the player's knees, called "Knee Levers". In this particular example, fourteen frames 50 will be individually actuated by ten foot pedals 60 and four knee levers. Only two foot pedals 60 are shown in FIG. 1, since such showing is sufficient to illustrate the invention. Each pedal 60 can activate each string 18 to a different setting depending upon how screws 54 are set by the player.

Referring now to FIG. 3, each pedal 60 and/or knee lever is mechanically associated with a bellcrank 62 capable of controlling the slidable movement of each frame 50 by means of a wire, rod, cable or the like 64 extending between the forward frame member 50*a*, and linkage 62. When one of the pedals 60 is pressed down, frame 50 will move to the left in FIG. 3, stop members 66 arranged within the path of the frame 50 providing a forward limit stop for the degree of depression of the pedals 60 and rectangular frame 50.

A stop bar 70 mounted transversely with respect to the supporting walls 58 provides a rear stop limit for the pitch raising and lowering levers 26 and 28, respectively. Each pitch lowering lever 28 is bias loaded counter-clockwise against the stop bar 70 by means of a tensed resilient link 72 extended between an anchor hole 48 included in lever 28 and the stop bar 70. The members 72 may be adjustably connected to stop bar 70 by screws 74, and an adjustment nut 74*a*.

FIG. 5 shows a schematic illustration of the units 24 or pitch raising and lowering levers 26 and 28 mounted side by side on shaft 30 and extended downward through frames 50'–50'' in their inactive position. It can be seen that the controlling pin 46 normally abuts the high point or crest of the cam surface 38. The tension of the string 18 keeps the raising lever 26 rotated counter-clockwise against stop bar 70. Tensed resilient link 72 keeps lowering lever 28 rotated counter-clockwise against stop bar 70. None of the adjustment set screws 54*a* and 54*b* are in contact with the levers 26 and 28. The string 18 is at its basic pre-set tension. The adjustment of the screws 54*a* and 54*b* varies the degree of rotation of levers 26 and 28. By controlling the degree of rotation, the player can control the amount of pitch he wants to change.

Figure 6:
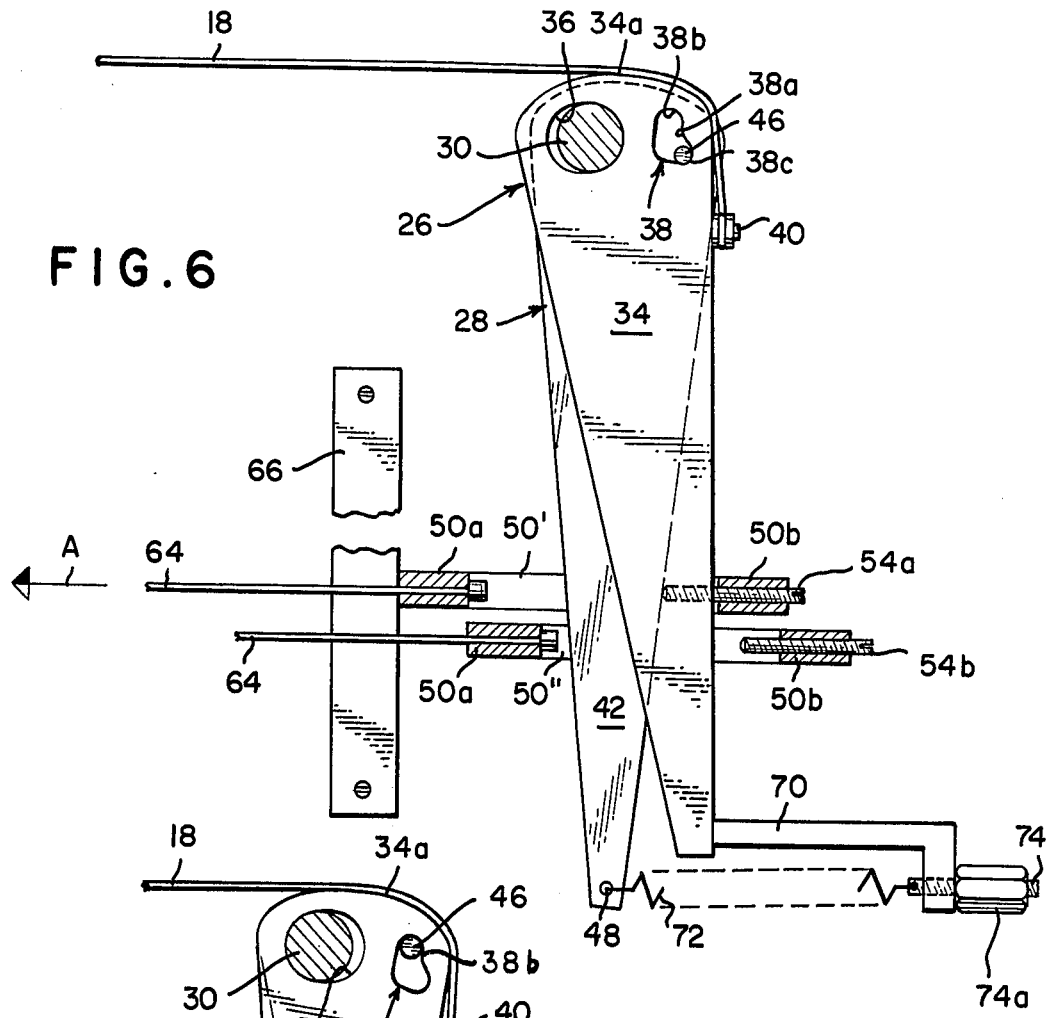
FIG. 6 shows a similar view to FIG. 5 but the pitch lowering lever is illustrated in an activated position.

Referring to FIG. 6, it will be seen that the pitch lowering lever 28 is shown in an activated position. When one of the pedals 60 is pressed down, due to the linkage 64, frame 50' is pulled to the left as indicated by arrow A. The adjustment screw 54*a* contacts the lever 28 rotating it clockwise until frame 50' hits stop member 66. In view of this action, the controlling pin 46 moves downward toward the cam surface 38*c*, allowing the pitch raising lever 26 to slide forward, to the left, because of the tension of the string 18 and the oblong hole 36, therefore decreasing the tension of the string and lowering the pitch thereof.

Upon release of pedal 60, frame 50' returns to the right, to its inactive position allowing lever 28 to rotate counterclockwise due to the tension of the tensed resilient link 72. The lever 28 is then pulled back against stop bar 70. The rotating action of the controlling pin 46 bearing against cam surface 38*c* forces the pitch raising lever 26 back (to the right) to its basic inactive position as shown in FIG. 5. Thus, string 18 is restored to its basic pre-set initial tension.

Figure 7:
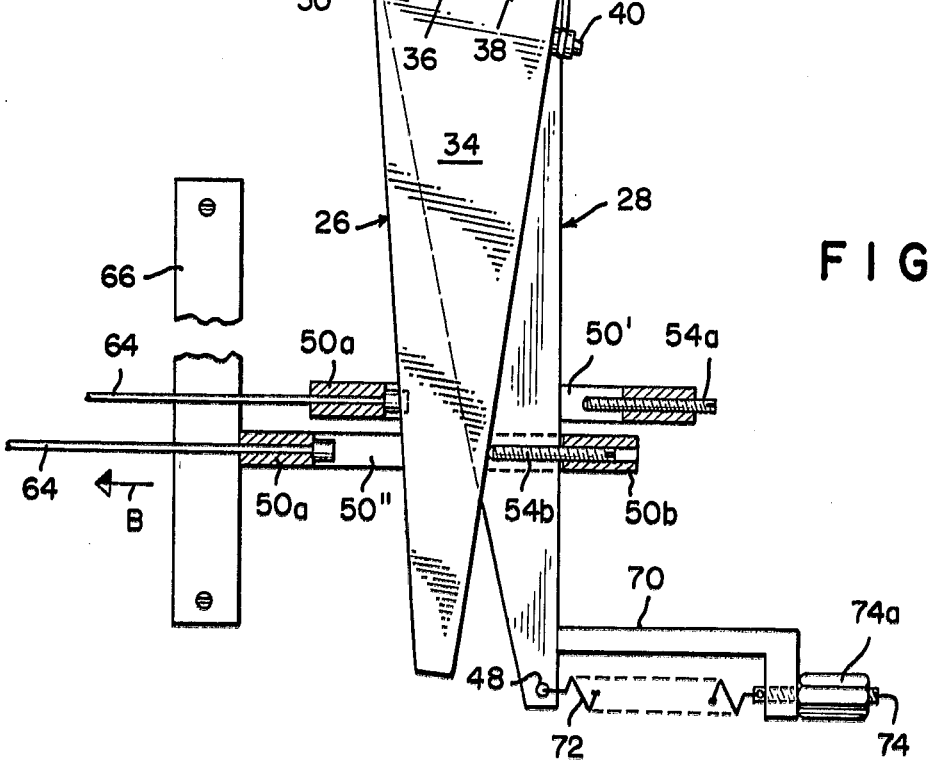
FIG. 7 shows a similar view to FIG. 5 but in this representation the raising lever is shown in an activated position.

Referring now to FIG. 7, the pitch raising lever 26 is shown in an activated position. When pedal 60 is pressed down, frame 50'' is pulled to the left, as indicated by arrow B. The adjustment screw 54*b* contacts raising lever 26, rotating it clockwise until frame 50'' hits stop member 66.

Since controlling pin 46 will remain generally stationary, it constrains lever 26 to a rotary motion whereby pin 46 will be located at the cam surface 38*b*, thus effecting an increase in the tension of the string 18 and raising the pitch thereof.

Upon release of pedal 60, frame 50'' returns to the right allowing raising lever 26 to rotate counterclockwise due to the string tension until it hits the stop bar 70 which is its basic inactive position, as shown in FIG. 5. Thus, string 18 is restored to its basic pre-set initial tension.

It will now be apparent that with the arrangement of the present invention, the player is able to "program" the individual units in such a manner that upon the activation of any pedal or knee lever, and controlling mechanism associated therewith, he may selectively increase or decrease the tension and/or pitch of any string, as many times as there are pedals and knee levers on the instrument, affording an infinitely variable means of adjustability. If the player so desires he may leave the basic pitch of any string unchanged, by merely backing off the adjustment screws far enough so that they do not come in contact with the levers when the pedal mechanism is actuated.

It is also apparent that the player can quickly and easily change the "programming" of the adjustments without any disassembly of the mechanism.

It will also be apparent that by simultaneously activating two adjacent pedals or a pedal and knee lever, one pedal or knee lever being pre-set to raise the pitch of a string, while the other pedal or knee lever is pre-set to lower the pitch of the same string, the player will obtain an additional note, which is the proportional difference and/or the result of the two functions acting upon the same string at the same time.

For a two or three neck instrument, similar tone changing means may be applied to each neck in an obvious manner. It is also obvious how the instant invention may be applied to any instrument, regardless of the number of strings it possesses.

In view of the "infinite" tuning versatility which can be obtained by the novel bi-directional string tension adjusting mechanism, there is no limit to the amount of variations or tone changing combinations that may be obtained from each of the strings on a steel guitar provided with this mechanism.

While this invention has been described with particular reference to the embodiment illustrated in the drawing, such is not construed as a limitation upon the invention which is best defined in the appended claims.

What I claim is:

1. A stringed musical instrument including:

a means supporting thereon a plurality of strings, a plurality of tuning keys each having one end of a corresponding string attached thereto for controllably tensioning said strings to a basic normally tuned condition corresponding to a predetermined nominal tone, tone changing means connected to the other end of each string including a shaft and a pair of operable members pivotally supported on said shaft and each capable of being rotated about said shaft from a normal first position to a second variable position, actuation of either of said members to its second variable position altering the pitch of the associated string by an amount dependent on the second variable position, the first of said operable members comprising an elongated flat member having an arcuate head, an oblong hole, and an eccentric cam slot means the other end of each of said strings being operatively connected to the upper end of a corresponding first member, the second of said operable members comprising substantially the same configuration as said first lever with a circular hole and an extending controlling pin, said oblong hole of said first lever being aligned with said circular hole of said second lever, said controlling pin registering within said eccentric cam slot means, a plurality of pedals and means for coupling any one of said pedals to either of said operable members for any said string to selectively change the pitch of any string by an amount dependent on which pedal is actuated, and means responsive to the concurrent actuation of a pair of pedals coupled respectively to both said operable members associated with any string to produce a third change of pitch of said string which is different from the amount of pitch change occuring in response to actuation of either of said pair of pedals alone.

2. The stringed musical instrument as defined in claim 1 wherein a stop bar mounted transversely with respect to said first member and said second member, behind the lowermost rearward portion thereof, provides positive counterclockwise positioning for said first member and said second member.

3. The stringed musical instrument as defined in claim 2 wherein said second member is operatively connected to a tensed resilient link at the lower end thereof, whereby both members are bias loaded against said stop bar; said first member by the pulling action of the string tension and said second member by the pulling action of the tensed resilient link.

4. The stringed musical instrument as defined in claim 1 wherein said eccentric cam slot means comprises a plurality of eccentric cam slot surfaces, a first cam surface adjacent to the upper rearward end of said first member, a second cam surface positioned below said first cam surface and having a curved crest extending in from the rearward portion of said first member, and a third cam surface positioned below said second cam surface extending downwardly toward the rearward portion of said first member, each of said cam surfaces cooperating with said controlling pin in an abutting engagement between said first and second members, whereby the relative rotation of said first member about the supporting shaft with respect to said second member in response to the pedal operated means will decrease the tension of the string associated with said members, and the relative rotation of said second member about said shaft with respect to said first member in response to said pedal operated means will increase the tension of said string.

5. The stringed musical instrument as defined in claim 1 wherein said coupling means comprises a plurality of frames positioned substantially parallel to said strings and spaced vertically from one another, said frames comprising forward and rearward transverse members, and lateral end members defining a rectangular opening therethrough, said members extending downwardly through said opening, and a plurality of pedals each operatively connected to a respective one of said frames.

6. The stringed musical instrument as defined in claim 5 which further comprises a plurality of screws adjustably mounted in said rearward transverse member and projecting therethrough; each said screw being co-planar with a respective one of said members and movable in and out of said opening for controlling the rotational movement of the associated member about the supporting shaft, whereby the degree of change in the tension of a predetermined string or strings may be selectively controlled by the relative position of said screws in and out of said opening.

7. The stringed musical instrument as defined in claim 5 wherein said plurality of frames are slidably constrained to horizontal linear movement by supporting means extending vertically downwardly, each said frame being movable in parallel grooves in said supporting means; whereby upon actuation of a pedal produces translational movement of a corresponding frame to actuate selected ones of said members and change the pitch of the string associated therewith.

* * * * *